US009144990B2

(12) United States Patent
Maeshima

(10) Patent No.: US 9,144,990 B2
(45) Date of Patent: Sep. 29, 2015

(54) INK CONTAINER AND INKJET IMAGE FORMING APPARATUS

(71) Applicant: KYOCERA DOCUMENT SOLUTIONS INC., Osaka-shi, Osaka (JP)

(72) Inventor: Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/228,095

(22) Filed: Mar. 27, 2014

(65) Prior Publication Data

US 2014/0292961 A1 Oct. 2, 2014

(30) Foreign Application Priority Data

Mar. 28, 2013 (JP) ..... 2013-068506

(51) Int. Cl.
*B41J 2/175* (2006.01)

(52) U.S. Cl.
CPC ..... *B41J 2/17553* (2013.01); *B41J 2/17513* (2013.01); *B41J 2002/17516* (2013.01)

(58) Field of Classification Search
CPC ..... B41J 2002/17516
See application file for complete search history.

(56) References Cited

U.S. PATENT DOCUMENTS

| | | | | |
|---|---|---|---|---|
| 8,083,334 | B2 | 12/2011 | Nozawa | |
| 2005/0237368 | A1 * | 10/2005 | Matsumoto | 347/86 |
| 2008/0225093 | A1 | 9/2008 | Nozawa | |

FOREIGN PATENT DOCUMENTS

| | | | |
|---|---|---|---|
| JP | H01-141752 | A | 6/1989 |
| JP | 2008-221675 | A | 9/2008 |
| JP | 2010-082991 | A | 4/2010 |
| JP | 2010-208095 | A | 9/2010 |

OTHER PUBLICATIONS

An Office Action; "Notice of Reasons for Rejection," issued by the Japanese Patent Office on May 19, 2015, which corresponds to Japanese Patent Application No. 2013-068506 and is related to U.S. Appl. No. 14/228,095.

The First Office Action issued by the State Intellectual Property Office of People's Republic of China on Jun. 3, 2015, which corresponds to Chinese Patent Application No. 201410073403.9 and is related to U.S. Appl. No. 14/228,095.

* cited by examiner

*Primary Examiner* — Geoffrey Mruk
(74) *Attorney, Agent, or Firm* — Studebaker & Brackett PC

(57) ABSTRACT

An ink container includes a liquid storing container and a container case. The liquid storing container is filled with an ink and provided with a spout discharging the ink at one end side. The container case contains the liquid storing container and fixes one end of the liquid storing container. The ink storing container contracts and lengthens in forward and backward directions in accordance with reduction in the ink from a state where the ink is filled inside. The container case includes a first housing part and a second housing part. The first housing part houses the liquid storing container in an ink filled state. The second housing part has the height dimension smaller than the height dimension of the first housing part and houses a lengthened amount of the liquid storing container at another end side of the first housing part depending on the reduction in the ink.

12 Claims, 17 Drawing Sheets

INK CONTAINER AND INKJET IMAGE FORMING APPARATUS

INCORPORATION BY REFERENCE

This application is based on and claims the benefit of priority from Japanese Patent application No. 2013-068506 filed on Mar. 28, 2013, the entire contents of which are incorporated herein by reference.

BACKGROUND

The present disclosure relates to an ink container and an inkjet image forming apparatus equipped with the ink container.

The inkjet image forming apparatus forms an image on a surface of a sheet by discharging an ink from a recording head to the sheet. The ink discharged from the recording head to the sheet is supplied from an ink container to the recording head.

The ink containers are configured to fit into various image forming apparatuses, respectively. For example, there is an ink container holding a large quantity of the ink. The ink container holding the large quantity of the ink may be configured to house a pouch pack filled with the ink and to discharge the ink from the pouch pack. As one example, as shown in FIGS. 16 and 17, an ink container 101 includes a pouch pack 102 filled with an ink, and a container case 103 containing the pouch pack 102. The pouch pack 102 is configured to be formed into a bag shape with a gusset by a flexible film material, thereby expanding when the ink is filled, and contracting when the ink is used and reduced.

For example, there is an image forming apparatus to use an ink cartridge (an ink container) housing a liquid storing case (a pouch pack). The liquid storing case is configured to have creases formed at the both sides in parallel with an insertion direction and to collapse along the creases as an internal ink flows out.

As mentioned above, the pouch pack with the crease at the both sides deforms so as to expand but to shorten in forward and backward directions when the ink is filled, while to contract but to lengthen when the ink is reduced. However, in views of shock resistance in transportation and volume efficiency, an ink container 101, such as the above-mentioned ink cartridge, is formed so that the length of the container case 103 in the forward and backward directions matches to the length of the pouch pack 102 in an expanded state (see FIG. 16). Accordingly, even if the pouch pack were 102 deformed in accordance with reduction in the ink, because the end of the pouch pack 102 collides with an inner wall of the container case 103, the lengthening of the pouch pack 102 is prevented (see FIG. 17). Thus, if the pouch pack 102 were not lengthened sufficiently, because an expanded portion of the pouch pack 102 is stayed, the ink is not completely discharged and remained.

Since the ink remained in the pouch pack in this way cannot be discharged by the ink container configured as mentioned above, the pouch pack is determined as a used one before the ink is used up, and then, the ink container or the pouch pack must be replaced with new one. However, if the ink in the pouch pack cannot be used up, replacement frequency becomes higher and a workload of a user increases. In addition, the replacement of the pouch pack having the remained ink causes user's dissatisfaction.

Further, since the expanded portion of the pouch pack in an ink filled state struts, the gusset is not buckled when the ink is reduced, and the ink is not discharged, but remained. Especially, the pouch pack is susceptible to the strutting in a left state, such as during transportation or preservation. Moreover, the ink tends to be left at the side distant from a part fixing the pouch pack in the ink container. Such difficulty in folding the gusset cannot be avoided even when a space used for lengthening and deforming the pouch pack is arranged inside the ink container.

SUMMARY

In accordance with an embodiment of the present disclosure, an ink container includes a liquid storing container and a container case. The liquid storing container is filled with an ink and provided with a spout discharging the ink at one end side. The container case contains the liquid storing container and fixes one end of the liquid storing container. The ink storing container is configured to contract and to lengthen in forward and backward directions in accordance with reduction in the ink from a state where the ink is filled inside. The container case includes a first housing part and a second housing part. The first housing part houses the liquid storing container in an ink filled state. The second housing part has the height dimension smaller than the height dimension of the first housing part and houses a lengthened amount of the liquid storing container at another end side of the first housing part depending on the reduction in the ink.

Furthermore, in accordance with an embodiment of the present disclosure, an ink jet image forming apparatus includes an ink container. The ink container includes a liquid storing container and a container case. The liquid storing container is filled with an ink and provided with a spout discharging the ink at one end side. The container case contains the liquid storing container and fixes one end of the liquid storing container. The ink storing container is configured to contract and to lengthen in forward and backward directions in accordance with reduction in the ink from a state where the ink is filled inside. The container case includes a first housing part and a second housing part. The first housing part houses the liquid storing container in an ink filled state. The second housing part has the height dimension smaller than the height dimension of the first housing part and houses a lengthened amount of the liquid storing container at another end side of the first housing part depending on the reduction in the ink.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First, with reference to FIGS. 1 to 4, the entire structure of an inkjet color printer 1 (hereinafter, abbreviated to a "printer 1") as an inkjet image forming apparatus will be described. Hereinafter, a near side (a reader's side) of FIGS. 1 and 2 will be described as the front side of the printer 1 and arrows Fr indicate the front side of the printer 1.

Figure 1:
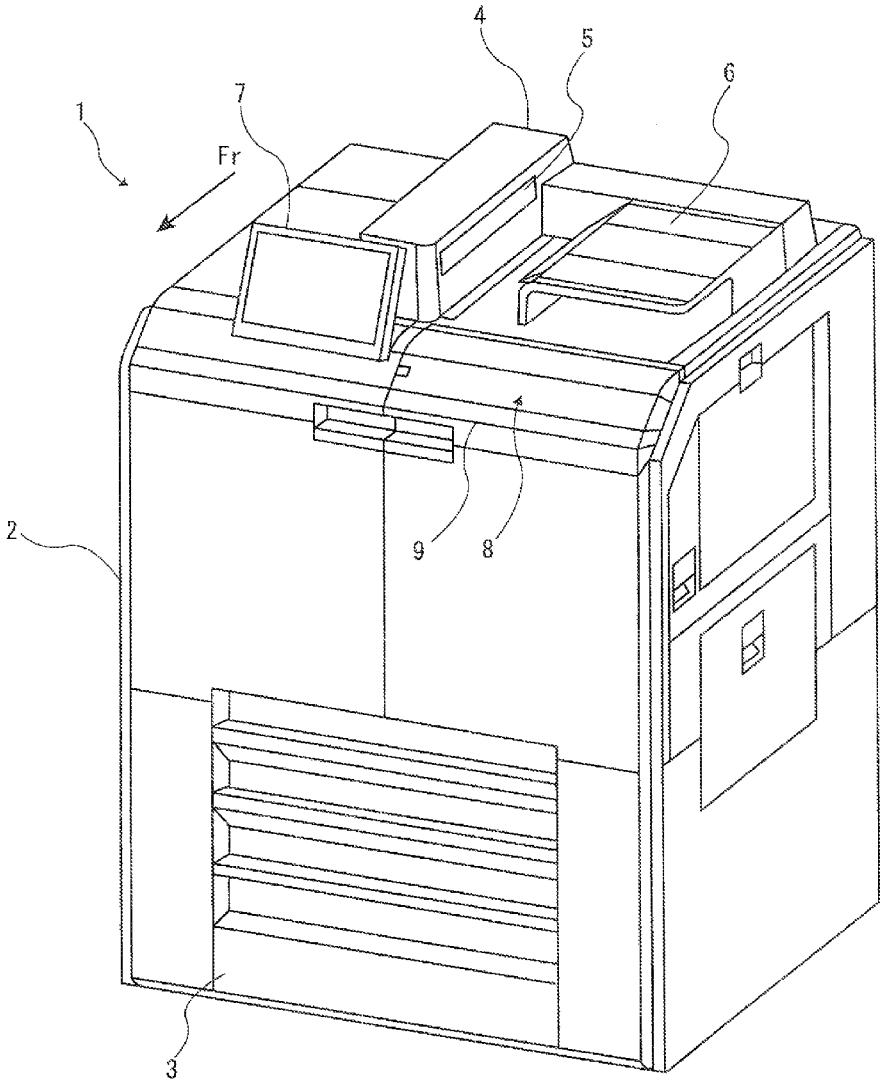
FIG. 1 is a schematic diagram schematically showing a printer according to an embodiment of the present disclosure.
Figure 2:
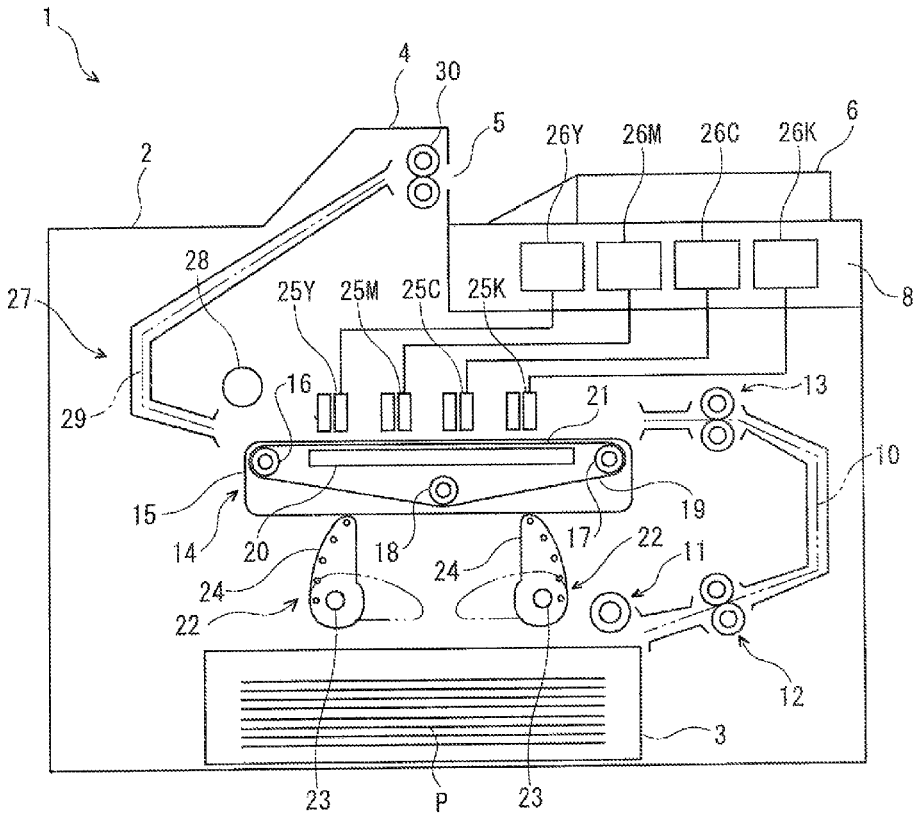
FIG. 2 is a sectional view schematically showing the printer according to the embodiment of the present disclosure.

As shown in FIGS. 1 and 2, the printer 1 includes a box-formed printer main body 2. In a lower part of the printer main body 2, a sheet feeding cartridge 3 configured to store a sheet P is installed pullably. Although, in FIG. 1, a plurality of sheet feeding cartridges 3 are illustrated, in FIG. 2, one sheet feeding cartridge 3 is illustrated and other sheet feeding cartridges 3 are omitted for the sake of convenience of the description.

Figure 3:
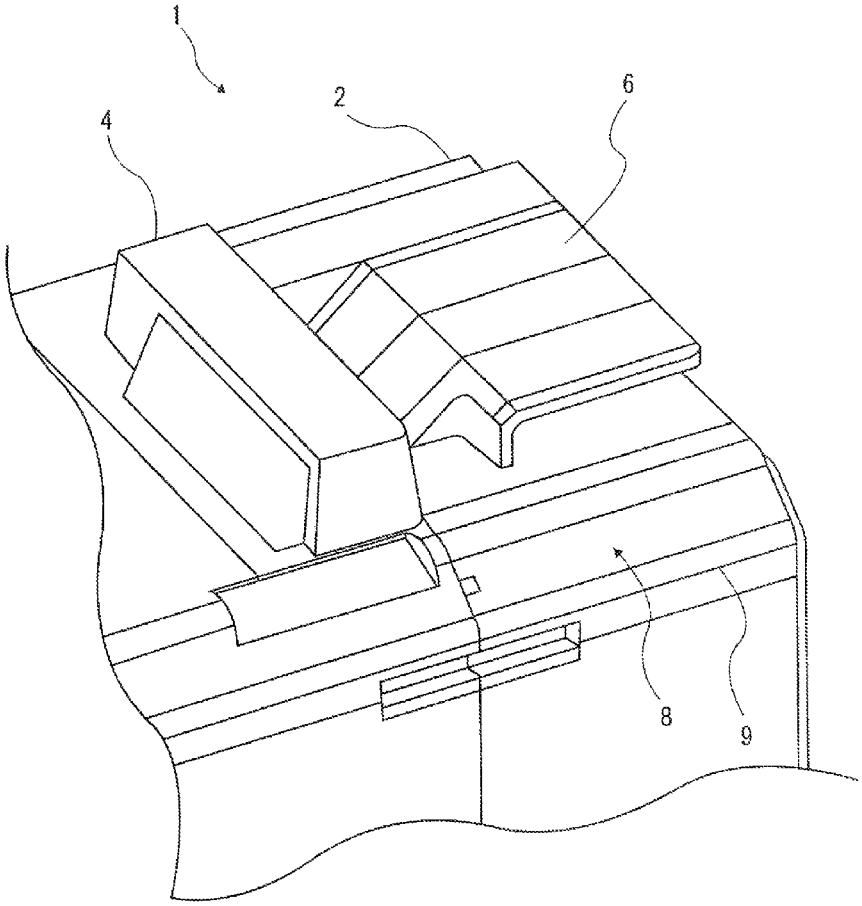
FIG. 3 is a perspective view showing the printer in a state, where an installation cover of a container installed part is closed, according to the embodiment of the present disclosure.
Figure 4:
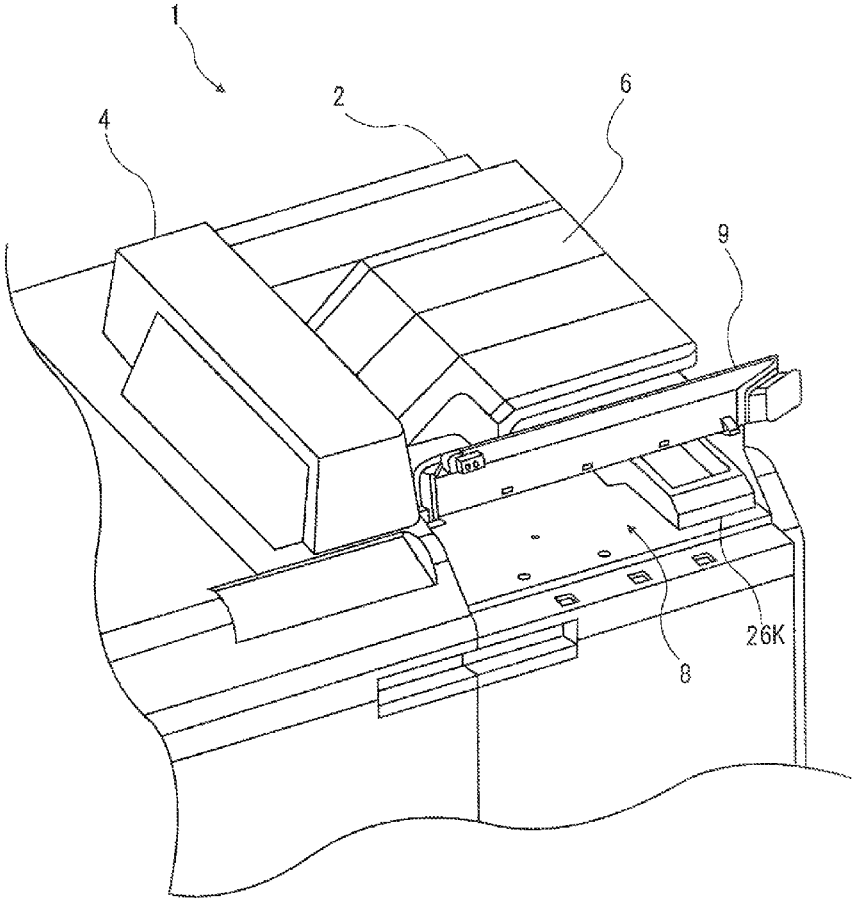
FIG. 4 is a perspective view showing the printer in another state, where the installation cover of the container installed part is opened, according to the embodiment of the present disclosure.

In a top face of the printer main body 2, a protrusion 4 is formed in the vicinity of the center. In a right face of the protrusion 4, an ejecting port 5 ejecting the sheet with a formed image is opened. In the top face of the printer main body 2, an ejected sheet tray 6 receiving the sheet with the formed image is arranged at the right side of the protrusion 4 and a touch panel-type operational panel 7 is attached at the front side of the protrusion 4. FIGS. 3 and 4 illustrate a state, where the operational panel 7 is detached, for the sake of convenience of the description. Further, in a right upper part of the printer main body 2, a container installed part 8 is arranged. On a front face of the container installed part 8, an installation cover 9 is attached openably/closably (refer to FIGS. 3 and 4).

As shown in FIG. 2, in a right part of the printer main body 2, a conveying path 10 for the sheet P is arranged. At an upstream end of the conveying path 10, a sheet feeding roller 11 is positioned near the sheet feeding cartridge 3 and, at the right side of the sheet feeding roller 11, conveying rollers 12 are positioned. At a downstream end of the conveying path 10, resist rollers 13 are positioned.

In an intermediate part of the printer main body 2, an upward/downward movable conveying unit 14 is attached. The conveying unit 14 includes a conveyance frame 15, a driving roller 16, a following roller 17, a tension roller 18, an endless conveyance belt 19 and an air intake duct 20. The driving roller 16 is rotatably supported at a left upper corner of the conveyance frame 15. The following roller 17 is rotatably supported at a right upper corner of the conveyance frame 15. The tension roller 18 is rotatably supported at a middle lower part of the conveyance frame 15. The conveyance belt 19 is wound around the driving roller 16, following roller 17 and tension roller 18. The air intake duct 20 is located so as to be surrounded by the conveyance belt 19.

In an upper face of the conveyance belt 19, a roughly flat conveyance face 21 is formed. The conveyance belt 19 has a lot of air intake holes (not shown) and a top face of the air intake duct 20 also has a lot of air intake holes (not shown). The air intake duct 20 is connected with a suction device (not shown), such as a suction pomp. Accordingly, by activating the suction device, an air can be sucked via the air intake holes of the conveyance belt 19 and the air intake holes of the air intake duct 20 from a surface side of the conveyance face 21 in the conveyance belt 19 to the air intake duct 20.

In an intermediate lower part of the printer main body 2, a pair of left and right elevating devices 22 is attached below the conveying unit 14. Each elevating device 22 includes a rotation axis 23 and a cam 24 supported by the rotation axis 23. The cam 24 is connected with a driving device (not shown), such as a driving motor. Accordingly, by activating the driving device, each cam 24 rotates around the rotation axis 23 so that a posture of the cam 24 is switched between an upright posture (refer to solid line in FIG. 2) and a laid-down posture (refer to two-dot chain line in FIG. 2). The cam 24 is switched to the upright posture to lift up the conveyance frame 15 and to move the conveying unit 14 upward or switched to the laid-down posture to release the lift of the conveyance frame 15 and to move the conveying unit 14 downward.

In the intermediate part of the printer main body 2, four recording heads 25 (25K, 25C, 25M, 25Y) are arranged in parallel above the conveying unit 14. The recording heads 25 correspond to black (K), cyan (C), magenta (M) and yellow (Y) from an upstream side (a right side in the embodiment) in order of a conveying direction of the sheet P. Hereinafter, except for the description to be specified by the colors, the reference characters "Y", "C", "M" and "K" with regard to the recording heads 25 are omitted. The recording heads 25 are provided with respective nozzles (not shown) facing to the conveyance face 21 of the conveyance belt 19. The recording heads 25K, 25C, 25M and 25Y are respectively connected to ink containers 26K, 26C, 26M and 26Y corresponding to same ink colors via ink supplying paths.

In the container installed part 8 in the upper part of the printer main body 2, four ink containers 26 (26K, 26C, 26M, 26Y) are installed in parallel attachably/detachably in forward and backward directions. In the embodiment, the front side of the printer 1 is a near side (other end side of the ink container 26) in an installing direction of the ink container 26 to the container installed part 8. The rear side of the printer 1 is a far side (one end side of the ink container 26) in the installing direction of the ink container 26 to the container installed part 8. The four ink containers 26 are provided for each ink color to store respective inks of black (K), cyan (C), magenta (M) and yellow (Y) from an upstream side (a right side in the embodiment) in order of the conveying direction of the sheet P. In FIG. 4, the ink container 26K corresponding to the black (K) is installed to the container installed part 8. Hereinafter, except for the description to be specified by the colors, the reference characters "Y", "C", "M" and "K" with regard to the ink containers 26 are omitted.

In the far side in the container installed part 8, hollow needles (not shown) connected to the ink supplying paths to the recording heads 25 are provided. The needle is configured to connect to a spout 47 of a pouch pack (a liquid storing case) 31 in the container case 32.

In a left upper part of the printer main body 2, an ejecting mechanism 27 is arranged. The ejecting mechanism 27 includes, for example, a drying device 28, an ejecting path 29 and ejecting rollers 30. Although, in the embodiment, the drying device 28 is located at the left upper side of the conveying unit 14, the printer 1 may be configured without the drying device 28. The ejecting path 29 is arranged at the left side of the conveying unit 14 to extend upward to the protrusion 4 of the printer main body 2. The ejecting rollers 30 are located at a downstream end of the ejecting path 29 and in the vicinity of the ejecting port 5 inside the protrusion 4.

Next, the operation of forming an image by the printer 1 having such a configuration will be described.

In the printer 1, when image data is received from an external computer or the like, the sheet P stored in the sheet feeding cartridge 3 is fed to the conveying path 10 by the sheet feeding roller 11. The sheet P fed to the conveying path 10 is conveyed to a downstream side of the conveying path 10 by the conveying rollers 12 and fed from the conveying path 10 to the conveyance face 21 of the conveyance belt 19 by the resist rollers 13. The sheet P fed to the conveyance face 21 of the conveyance belt 19 is absorbed to the conveyance face 21 of the conveyance belt 19 by suction force of the suction device (not shown) connected with the air intake duct 20.

On the other hand, to each recording head 25, the ink is supplied from each ink container 26. Each recording head 25 discharges the ink to the absorbed sheet P on the conveyance face 21 on the basis of the information of the image data received from the external computer or the like. Thereby, a color ink image is formed on the sheet P. The sheet P having the color ink image is advanced so that the ink on the surface is dried by the drying device 25, and then, passed through the ejecting path 29, and moreover, ejected on the ejected sheet tray 6 via the ejecting port 5 by the ejecting rollers 30.

Next, each ink container 26 will be described in detail with reference to FIGS. 5 to 11.

Each ink container 26 contains a pouch pack 31 elongated in forward and backward directions (see FIGS. 9 to 11) and is provided with a roughly box-shaped container case 32 elongated in the forward and backward directions and a spout cover 33 attached to a rear part of the container case 32 as shown in FIGS. 5, 6, and 9 to 11. In the ink container 26, the pouch pack 31 is housed in the container case 32 with one end (a leading end) to a rear side, i.e. backwardly.

Figure 8:
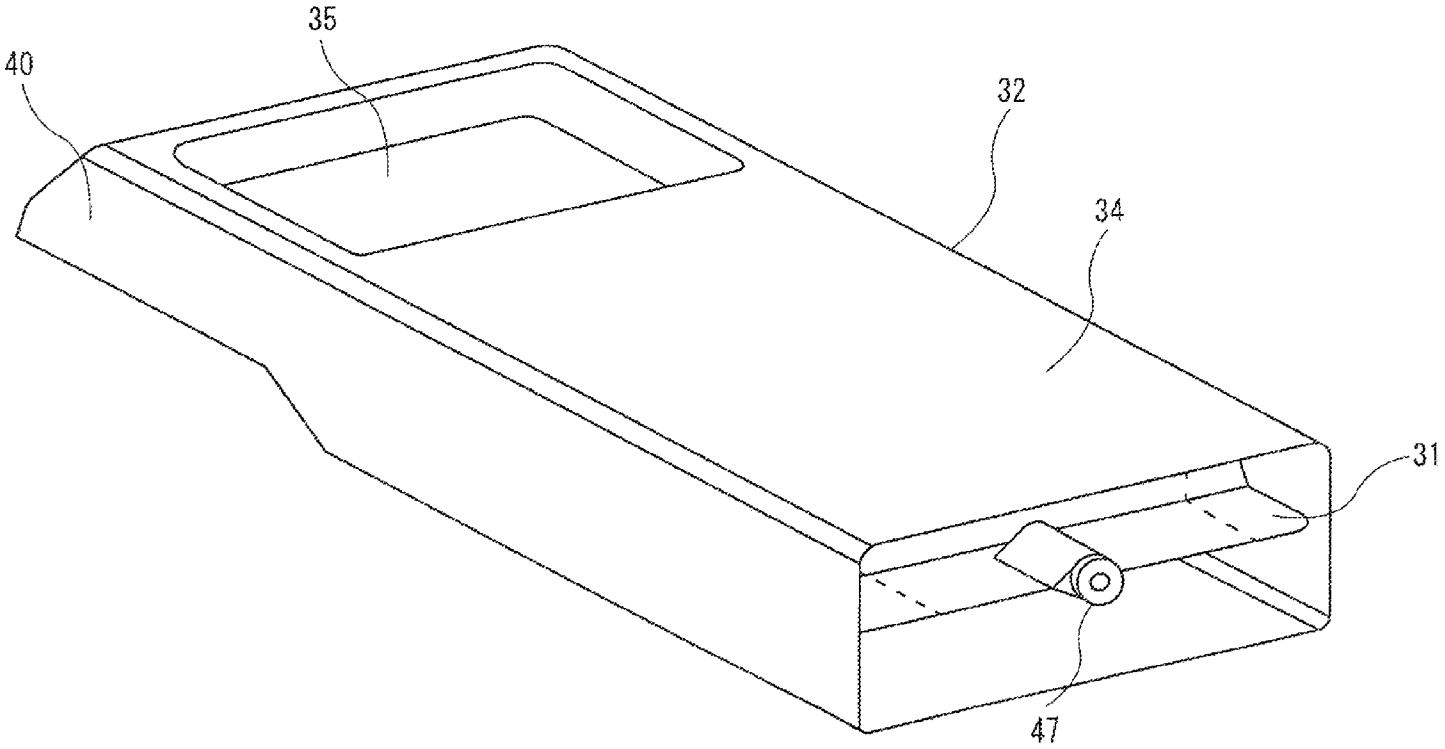
FIG. 8 is a perspective view showing the ink container in a state, where a spout cover is detached, applied to the printer according to the embodiment according to the present disclosure.

Now, the container case 32 will be described. As shown in FIG. 11, the container case 32 has a shape longer in the forward and backward directions than the pouch pack 31 in an ink used-up state, i.e. a contracted state. The container case 32 has a section intersecting perpendicularly a longitudinal direction so that a length in left and right directions is longer compared with a length in upward and downward directions. The container case 32 is a hollow container having an opened back end as shown in FIG. 8, and can house the pouch pack 31 from an opening formed in the back end. The container case 32 has a case main body 34 including the opening. Ahead of the case main body 34, an upper recess 35 and a lower recess 35 are formed to be recessed inward in an upper face and a lower face of the container case 32 (see FIGS. 9 to 11).

The case main body 34 is formed into a square tube shape elongated in the forward and backward directions and has a capacity of allowing the pouch pack 31 in an ink filled state to be housed except for a base end 37 at the other end side. The rear end of the case main body 34 is formed into a shape to which an insertion part 38 of the spout cover 33 can be fitted. On an inner peripheral surface at a rear part of the case main body 34, an engaging groove (not shown) to engage with engaging pawls 39 provided in the insertion part 38 of the spout cover 33 is formed.

The upper recess 35 and the lower recess 36 are formed, for example, into a rectangular shape having every sides surrounded by wall faces and having widths in the left and right directions longer than the width of the pouch pack 31 in upper and lower views, respectively. The depth dimension of the lower recess 36 is larger than the depth dimension of the upper recess 35 and a floor face of the lower recess 36 is positioned roughly at the center in the upward and downward directions of the container case 32. A front wall of the upper recess 35 is formed to have the height flush with the upper face of the case main body 34 and a front wall of the lower recess 36 is formed to have roughly the same height dimension as the height dimension of the front wall of the upper recess 35. In other words, the front end of the container case 32 located ahead of the upper recess 35 and the lower recess 36 is formed to have the height dimension smaller than the height dimension of the case main body 34.

The upper recess 35 and the lower recess 36 together with the front end of the container case 32 constitute a grasping part 40 elongated in the left and right directions. In a front face of the grasping part 40, a slope inclined toward an upper backward side may be formed. Below the grasping part 40, clearance is arranged as the grasping part 40 has the height dimension smaller than the height dimension of the case main body 34, and a user can insert user's hand into the clearance to grasp the grasping part 40.

Figure 9:
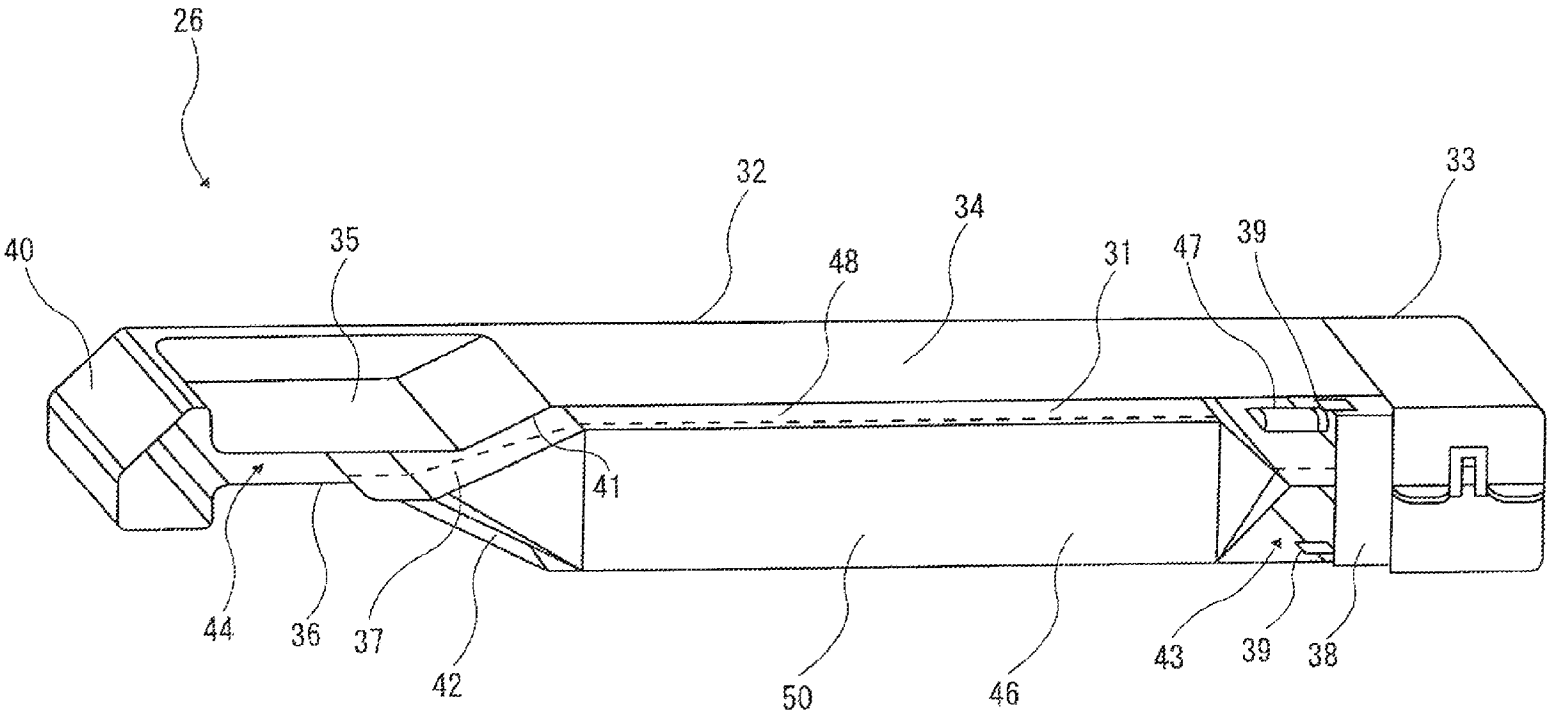
FIG. 9 is a partially cutaway perspective view showing the ink container, which contains a pouch pack filled with an ink, applied to the printer according to the embodiment of the present disclosure.
Figure 10:
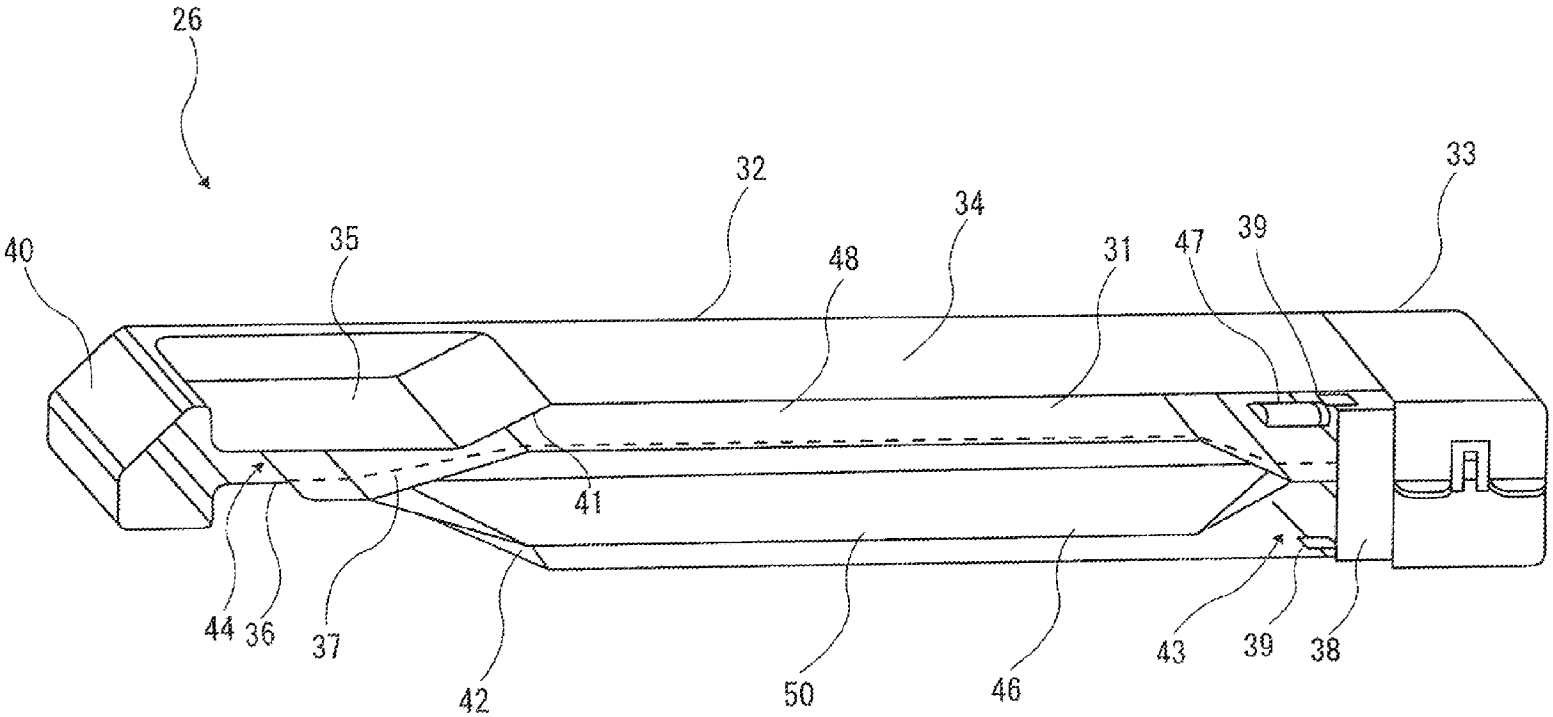
FIG. 10 is a partially cutaway perspective view showing the ink container, which contains the pouch pack during the ink is reducing, applied to the printer according to the embodiment of the present disclosure.
Figure 11:
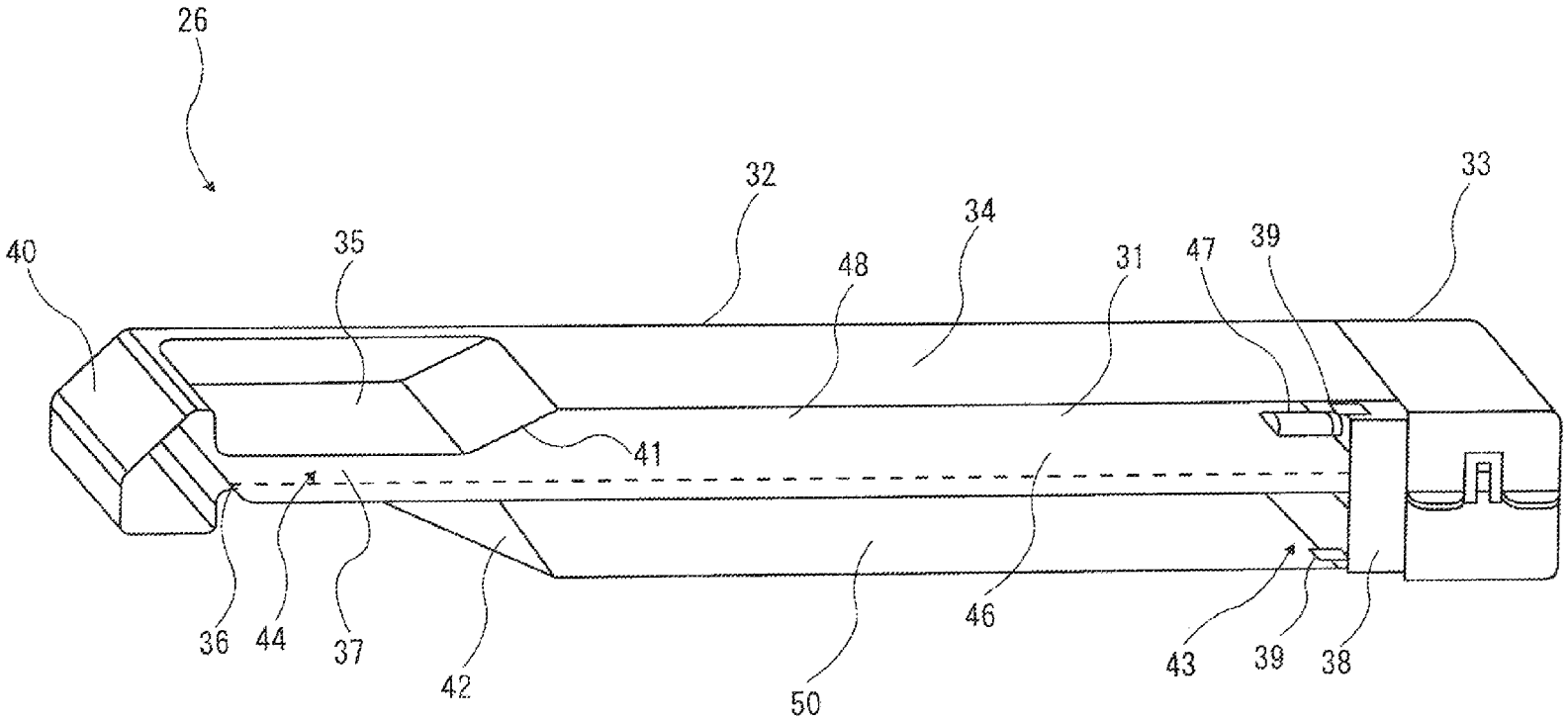
FIG. 11 is a partially cutaway perspective view showing the ink container, which contains the used pouch pack, applied to the printer according to the embodiment of the present disclosure.

Rear walls of the upper recess 35 and the lower recess 36 are formed respectively inclined toward the upper backward side and the lower backward side as shown in FIGS. 9 to 11. The rear wall of the lower recess 36 has the height dimension larger than the height dimension of a rear wall of the upper recess 35. In the back faces of the rear walls of the upper recess 35 and the lower recess 36, inside of the container case 32, an upper face guiding part 41 and a lower face guiding part 42 are formed to be inclined toward the front side and the center in the upward and downward directions from the case main body 34.

A hollow part of the container case 32 has the width larger than the width of the pouch pack 31 in the left and right directions as shown in FIG. 8, and includes a first housing part 43 corresponding to the case main body 34 and a second housing part 44 corresponding to the upper recess 35, the lower recess 36, and the grasping part 40 as shown in FIGS. 9 to 11.

The first housing part 43 has the height dimension larger than the height dimension of the pouch pack 31 in the ink filled state in the upward and downward directions, and has the length nearly the same as the length of the pouch pack 31 excluding the base end 37 in the ink filled state in a forward and backward directions.

In the second housing part 44, by the back faces of the rear walls of the upper recess 35 and the lower recess 36, the upper face guiding part 41 and the lower face guiding part 42 are respectively arranged to be inclined toward the front side and the center in the upward and downward directions from a ceiling face and a floor face of the first housing part 43. Thus, the height dimension of the rear part of the second housing part 44 is reduced so as to taper toward the front side and the center in the upward and downward directions in accordance with the upper face guiding part 41 and the lower face guiding part 42.

An intermediate part of the second housing part 44 is positioned in vicinity of the center of the container case 32 in the upward and downward directions, and has the height dimension excluding the depths of the upper recess 35 and the lower recess 36 from the height dimension of the first housing part 43. The intermediate part is configured to extend forward from the rear part and to house the pouch pack 31 thinned due to reduction in the ink. The front part of the second housing part 44 corresponding to the grasping part 40 also has the height dimension smaller than the height dimension of the first housing part 43.

Namely, the second housing part 44 is configured to house the base end 37 of the pouch pack 31 in the ink filed state housed in the first housing part 43. When the pouch pack 31 becomes thinner and lengthens (be stretched) in accordance with the reduction in the ink, an upper face and an lower face of the pouch pack 31 are respectively guided by the upper face guiding part 41 and the lower face guiding part 42 and inserted in the intermediate part, and therefore, the second housing part 44 can house a lengthened amount of the pouch pack 31.

Figure 5:
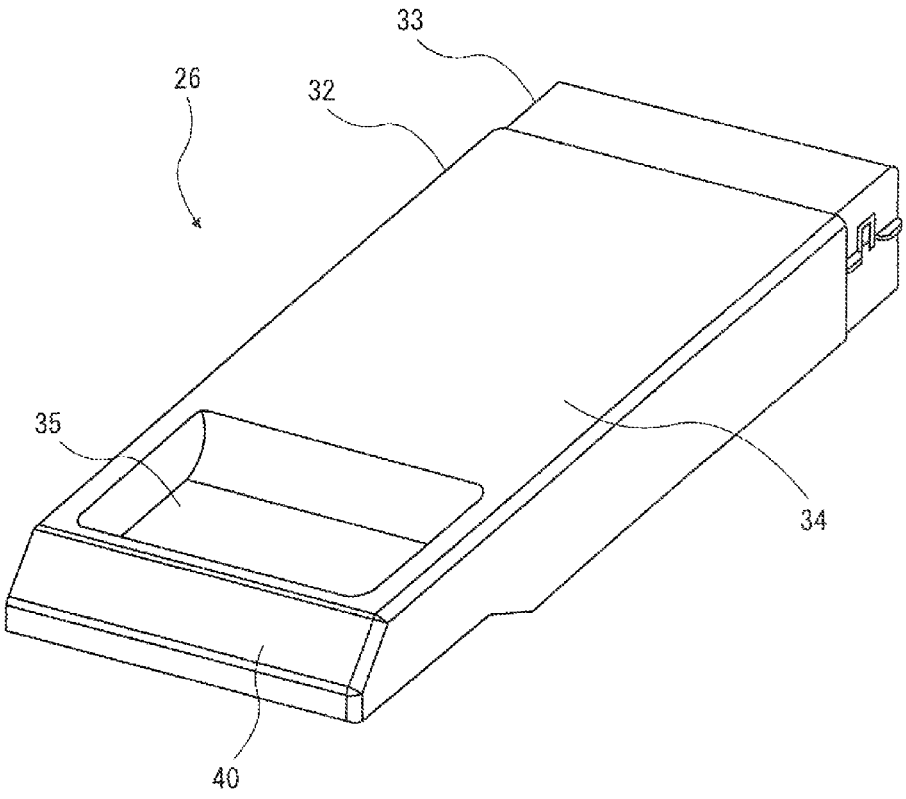
FIG. 5 is a front perspective view showing an ink container applied to the printer according to the embodiment of the present disclosure.
Figure 6:
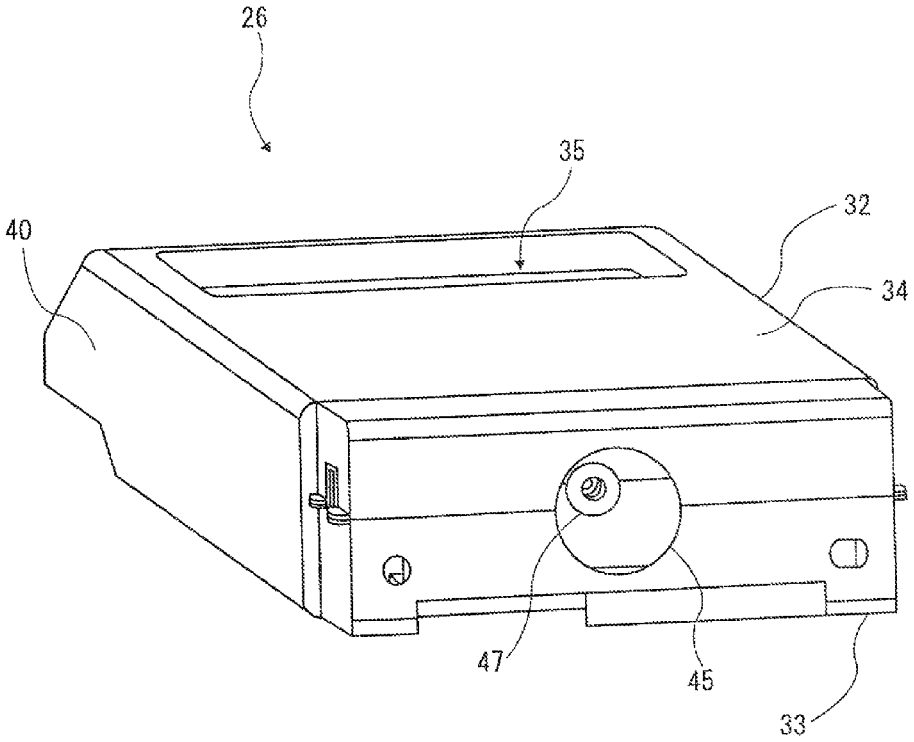
FIG. 6 is a rear perspective view showing the ink container applied to the printer according to the embodiment of the present disclosure.
Figure 7:
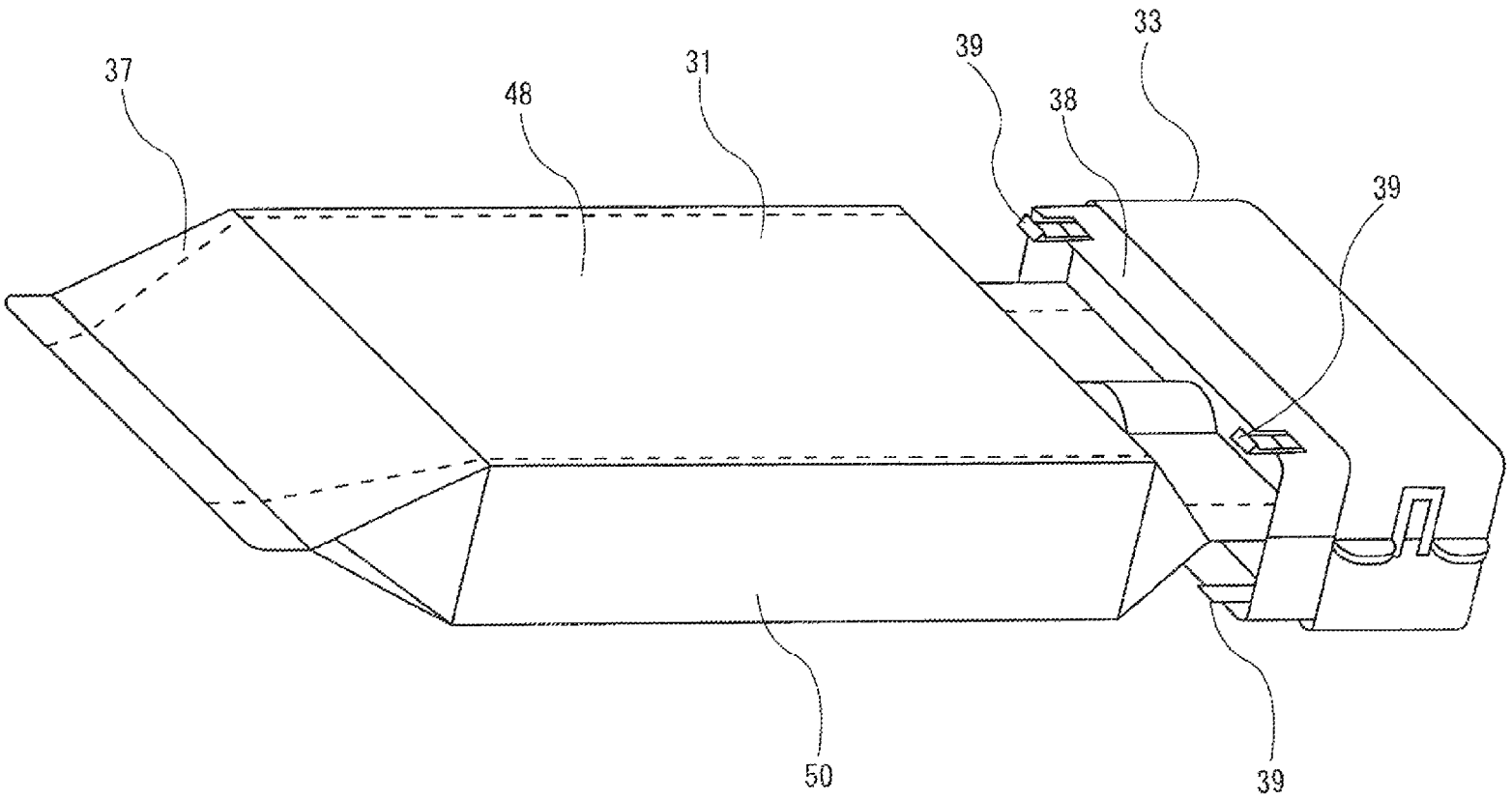
FIG. 7 is a perspective view showing the ink container in a state, where a container case is detached, applied to the printer according to the embodiment according to the present disclosure.

The spout cover 33 is formed, as shown in FIGS. 5 and 6, into a rectangular parallelopiped shape having the height flush with the case main body 34 of the container case 32 in the front view, and has an opened front end. At the center of a rear end face of the spout cover 33, a circle-formed needle inlet port 45 is opened. Further, at the front part of the spout cover 33, an insertion part 38 fitted to the case main body 34 is formed. An outer periphery of the insertion part 38 is smaller than an outer periphery of the case main body 34, and has nearly the same diameter as the diameter of an inner periphery of the case main body 34. In the front end of the insertion part 38, engaging crawls 39 engaging with an engaging groove (not shown) in an inner peripheral surface of the case main body 34 are formed. Inside the spout cover 33, a fixing mechanism (not shown) is provided to fix a leading end of the pouch pack 31 including the spout 47 at a center position in the upward and downward directions (see FIG. 7).

Next, the pouch pack 31 will be described in detail with reference to FIGS. 12 to 14.

Figure 12:
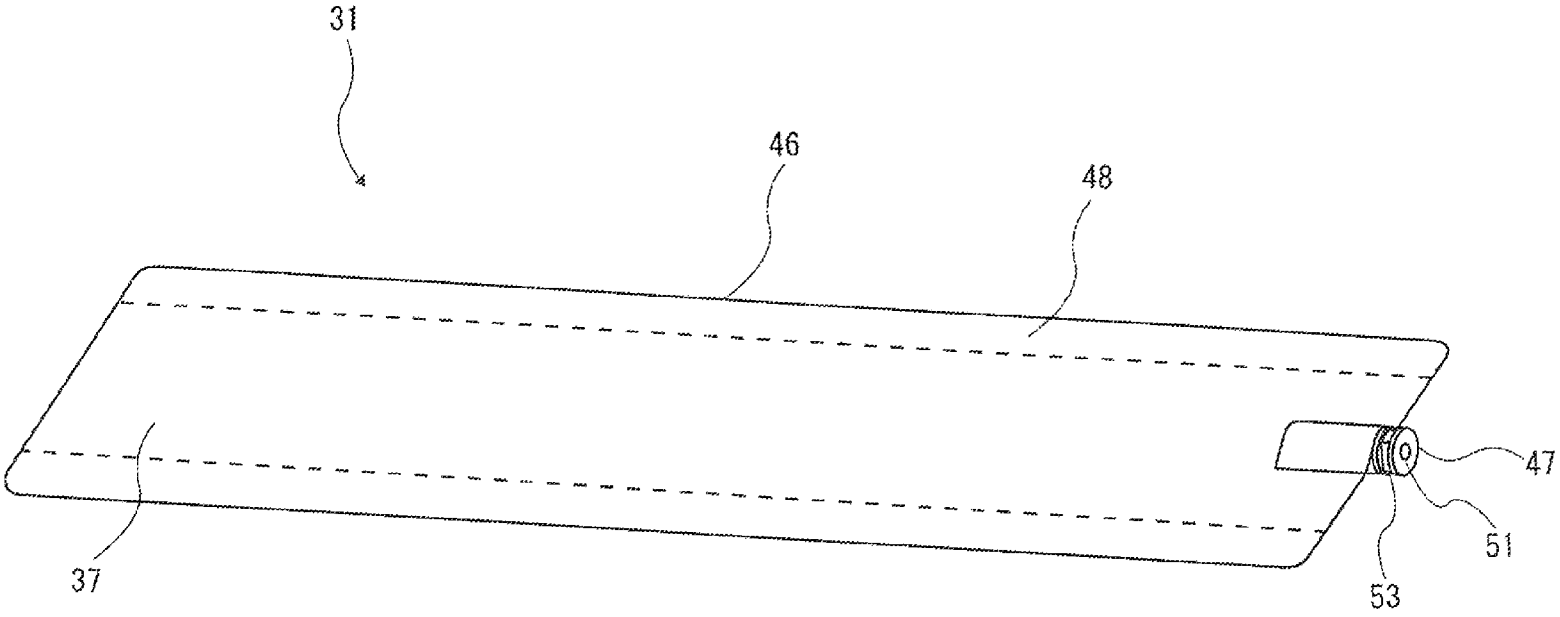
FIG. 12 is perspective view showing the pouch pack in an ink emptied state applied to the printer according to the embodiment of the present disclosure.
Figure 13:
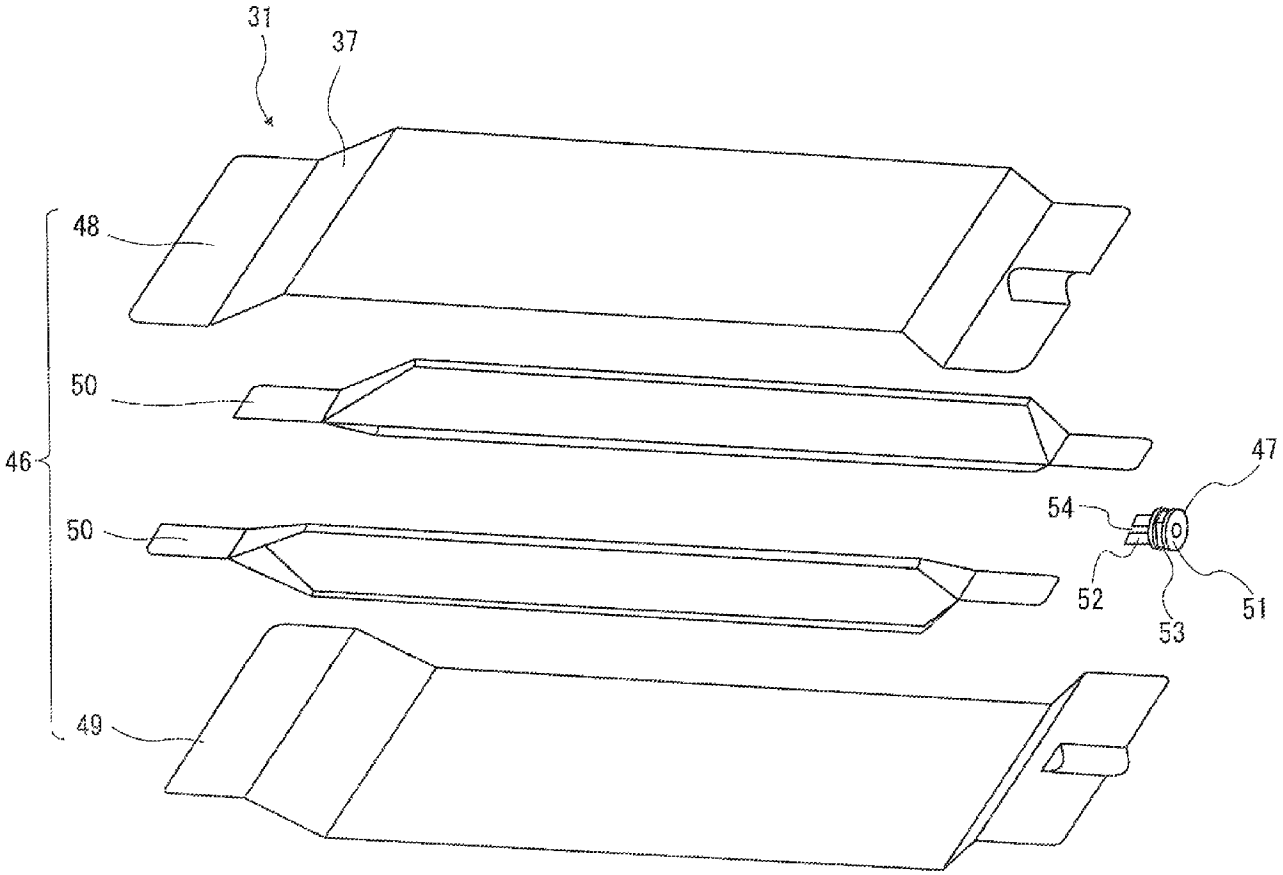
FIG. 13 is an exploded perspective view showing the pouch pack applied to the printer according to the embodiment of the disclosure.
Figure 14:
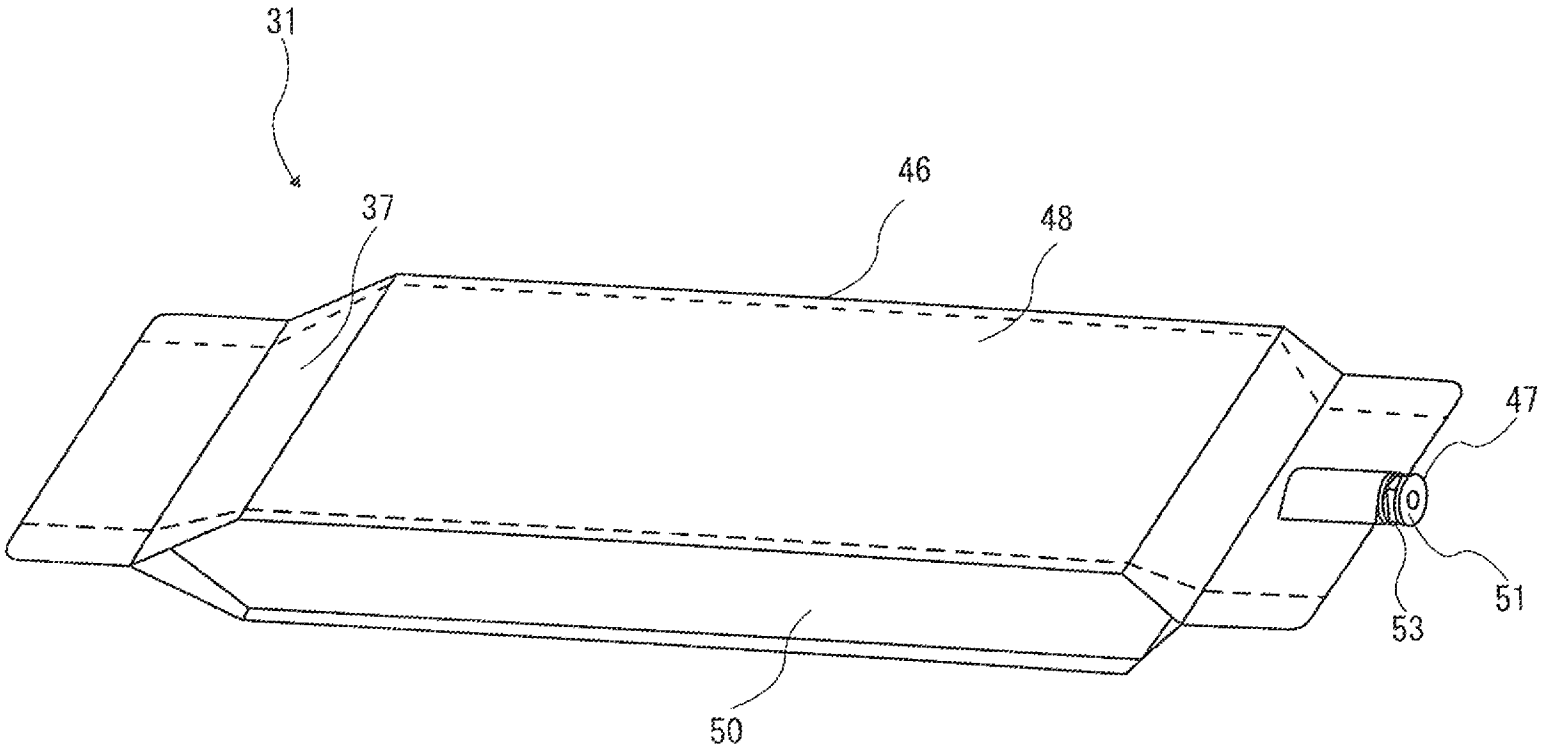
FIG. 14 is an exploded perspective view showing the pouch pack in an ink filled state applied to the printer according to the embodiment of the present disclosure.

As shown in FIGS. 12 to 14, the pouch pack 31 includes a pack main body 46 formed into a gusset type bag shape elongated in the forward and backward directions, and the spout 47 partially embedded in a leading end of the pack main body 46. The pouch pack 31 is configured so as to fill the ink in the pack main body 46 in a vacuum state, and to discharge the ink in the pack main body 46 via the spout 47 by inserting through the spout 47.

The pack main body 46 is made of a pliable (flexible) film material. The film material is made by laminating resin and aluminium. As one example, polyester (PET), aluminium (AL), nylon (PA), and low level density polyethylene (LL-DPE) are laminated in order from the surface side. Making a surface layer of the pack main body 46 from the polyester enables an external appearance and the strength of the pouch pack 31 to be improved. Forming an aluminium layer in the pack main body 46 enables gas barrier of the pouch pack 31 to be improved, thereby enhancing storability of the ink. Put differently, in the present embodiment, aluminium is used as a barrier material. Forming a nylon layer in the pack main body 46 enables the mechanical strength and shock resistance of the pouch pack 31 to be improved. Making a back face layer from the low level density polyethylene enables the welding strength of the pack main body to be heightened in forming the film material into a bag shape by welding, thereby improving sealing quality.

The pack main body 46 is formed, for example, so that, between a upper face film 48 and a lower face film 49 formed in flat plate shapes, a pair of side films 50 having respective gussets are provided at the both sides. Between leading end edges of the upper face film 48 and the lower face film 49, the spout 47 is provided at the center. Each side film 50 is folded back along a center line in the left and right directions, and internal surfaces opposite to each other are welded at the leading end edge and a base end edge. Both side edges of the upper face film 48 and the lower face film 49 are welded to the pair of side films 50. Further, the leading end edges are welded to each other together with the spout 47 and the base end edges are welded to each other, thereby ensuring liquid tightness of the pack main body 46.

When the inside of the pack main body 46 is expanded as in a case where the ink is filled in the pouch pack 31, the folding portions of the pair of the side films 50 are unfolded and the side films 50 are stood up, thereby separating the upper face film 48 and the lower face film 49 from each other. At this time, the front part and the rear part of the upper face film 48 and the lower face film 49 incline, and the length of the pouch pack main body 46, i.e. the length of the pouch pack 31, is shortened. Further, when the inside of the pack main body 46 is contracted as a case where the ink is discharged from the pouch pack 31, the pair of the side films 50 are folded along the folding portions, and then, the upper face film 48 and the lower face film 49 closely contact with each other, thereby lengthening the length of the pack main body 46, i.e. the length of the pouch pack 31. Since the upper face film 48, the lower face film 49, and the pair of the side films 50 have flexibility, these films can fold in spite of the presence of folding lines, i.e. the folding portions or creases, shown in FIG. 13. Notwithstanding, these films can be positively folded so as to lengthen in the forward and backward directions in accordance with the reduction in the ink by previously providing the folding lines.

The spout 47 includes a supply port 51 exposed from the pouch pack 31, and a connecting port 52 sealed between the upper face film 48 and the lower face film 49.

The supply port 51 is formed into a cylindrical shape and includes a seal part (not shown) sealing the inside to prevent leakage of the ink filled in the pouch pack 31. Further, the supply port 51 has a groove 53 formed along an outer periphery to ensure fixing of the spout 47 to the spout cover 33 by engaging the spout groove 53 with the spout cover 33. The seal part of the supply port 51 is configured to be passed through by a hollow needle (not shown) provided at the far side of the container installed part 8 when the container case 32 containing the pouch pack 31 is attached to the container installed part 8. The seal part closely contacts to an outer peripheral surface of the needle to prevent leakage of the ink when the seal part is passed through by the needle.

The connecting port 52 is formed into a hollow flat plate shape communicating with the supply port 51, and has a notch 54 at the rear end. The notch 54 enables the supply port 51 to communicate with the inside of the pack main body 46 even when the connecting port 52 is got caught between the upper face film 48 and the lower face film 49.

That is, the spout 47 is inserted through by passing the needle of the container installed part 8 through the seal part of the supply port 51. The pack main body 46 and the recording head 25 are communicated with each other through the spout 47 and the needle, thereby allowing the ink in the pack main body 46 to be supplied to the recording head 25.

In the present embodiment, as mentioned above, the ink container 26 includes the second housing part 44 that extends forward from the first housing part 43 corresponding to the case main body 34, and that has the height dimension smaller than the height dimension of the first housing part 43. Due to this, the second housing part 46 can house the lengthened amount of the pouch pack 31 even when a shape of the pouch pack 31 is deformed and lengthened depending on a residual quantity of the ink. Accordingly, the ink container 26 promotes the lengthening of the pouch pack 31 in the forward and backward directions by the second housing part 46, thereby deeply folding up the gussets of the side films 50 over the entire area in the forward and backward directions to contract the pouch pack 31 in the upward and downward directions. Thus, because the pouch pack 31 becomes thinner over the entire area in a horizontal direction in accordance with the reduction in the ink, the pouch pack 31 becomes available till almost all the ink is discharged, i.e. completely used up.

According to the present embodiment, the second housing part 44 of the ink container 26 is configured that the height dimension of the rear part is reduced so as to taper toward the front side and the center in the upward and downward directions by the upper face guiding part 41 and the lower face guiding part 42. On this account, when the pouch pack 31 becomes thinner and lengthens in accordance with the reduction in the ink, an upper face and a lower face of the pouch pack 31 are respectively guided toward the center in the upward and downward directions by the upper face guiding part 41 and the lower face guiding part 42. That is, the contraction of the pouch pack 31 in the upward and downward directions is promoted. Thus, the second housing part 44 is configured to promote not only the lengthening of the pouch pack 31 in the forward direction but also the contraction of the pouch pack 31 in the upward and downward directions, this allowing the lengthened amount of the pouch pack 31 to be smoothly housed.

Moreover, according to the present embodiment, an upper recess 35 and a lower recess 36 are provided in an upper face and a lower face of the front part of the ink container 26. For this reason, because the second housing part 44 is formed by utilizing the back faces of the upper recess 35 and the lower recess 36, the second housing part 44 enables promotion of the lengthening of the pouch pack 31 in the forward direction and contraction of the pouch pack 31 in the upward and downward directions with a simple configuration and can smoothly house the lengthened amount of the pouch pack 31. Further, because the grasping part 40 is formed by utilizing the front walls of the upper recess 35 and the lower recess 36 and the front end of the ink container 26, the holing part 40 facilitates a work by a user, such as attaching and detaching of the ink container 26, with a simple configuration.

Since the both side walls are provided at the upper recess 35 and the lower recess 36, the both sides of the container case 32 are formed with a thickness, thus improving the strength to load in the upward and downward directions. As the upper recess 35 and the lower recess 36 have a shape of sandwiching the pouch pack 31 inside of the container case 32, it is also possible to serve as a role of stably keeping a shape of the pouch pack 31 during transportation and preservation of the ink container 26. In a case where the container case 32 is configured so as to improve the strength by materials or other structure, the upper recess 35 and the lower recess 36 without left and right walls may be formed.

As mentioned above, according to the present disclosure, it is possible to securely deform the liquid storing container, such as the pouch pack, contracting in accordance with the reduction in the ink, and to use the liquid storing container till the ink is used up. Furthermore, according to the present disclosure, it is possible to hold the liquid storing container in the ink container without deforming the liquid storing container when the ink container is transported and preserved. At the same time, it is possible to make the ink container in a shape easy to perform replacing work without enlarging the size more than necessary.

Figure 15:
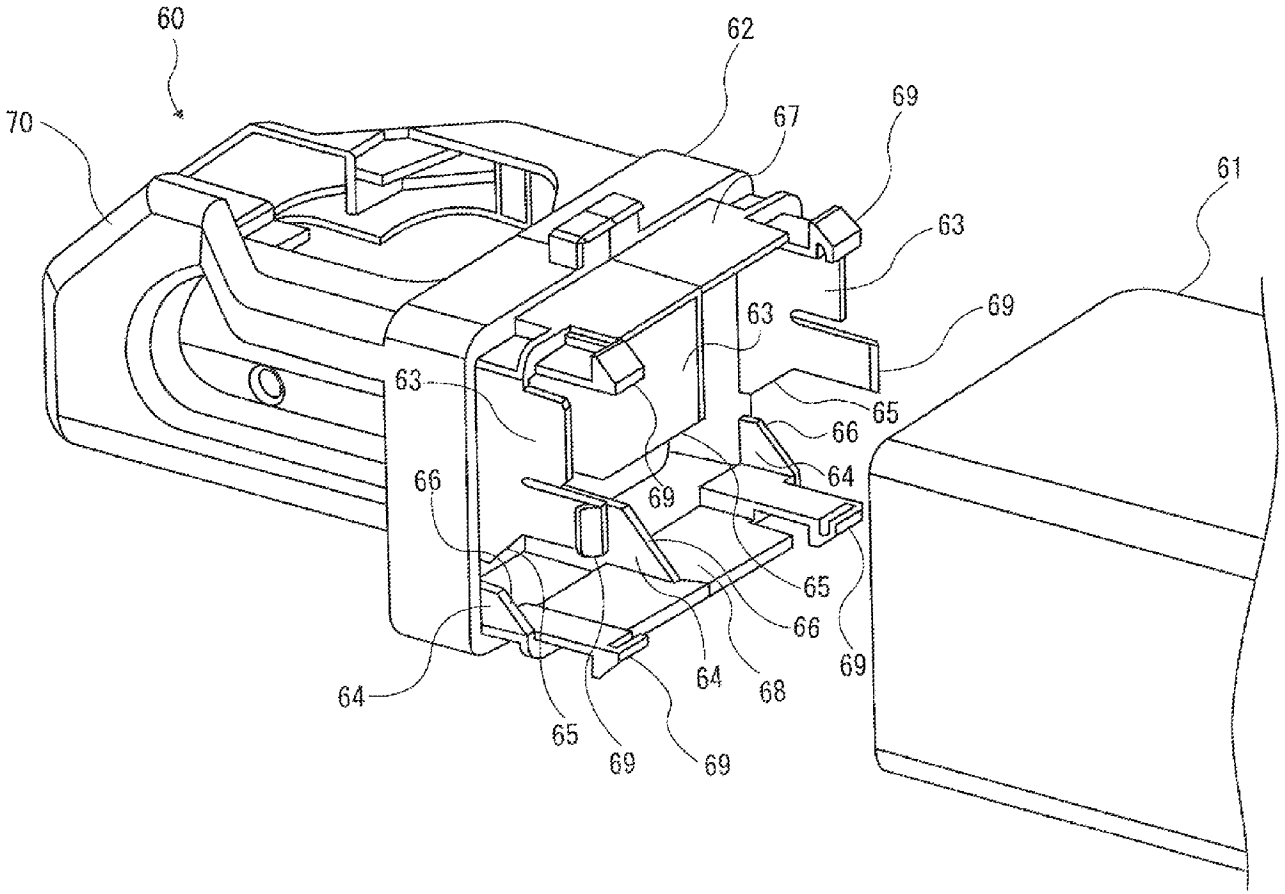
FIG. 15 is a perspective view showing a spout cover of the ink container applied to the printer according to another embodiment of the present disclosure.
Figure 16:
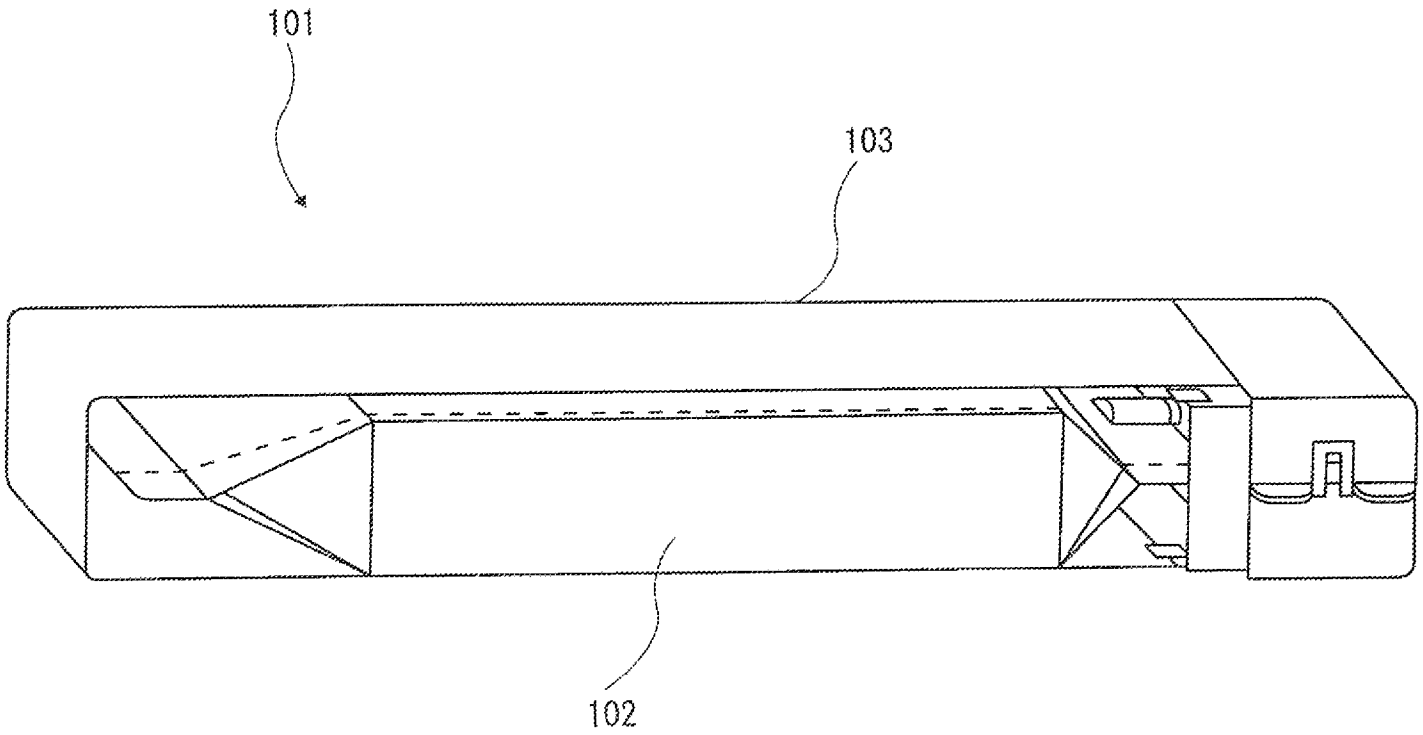
FIG. 16 is a partially cutaway perspective view showing an ink container containing a pouch pack filled with an ink in one example of an ink container applied to a printer.
Figure 17:
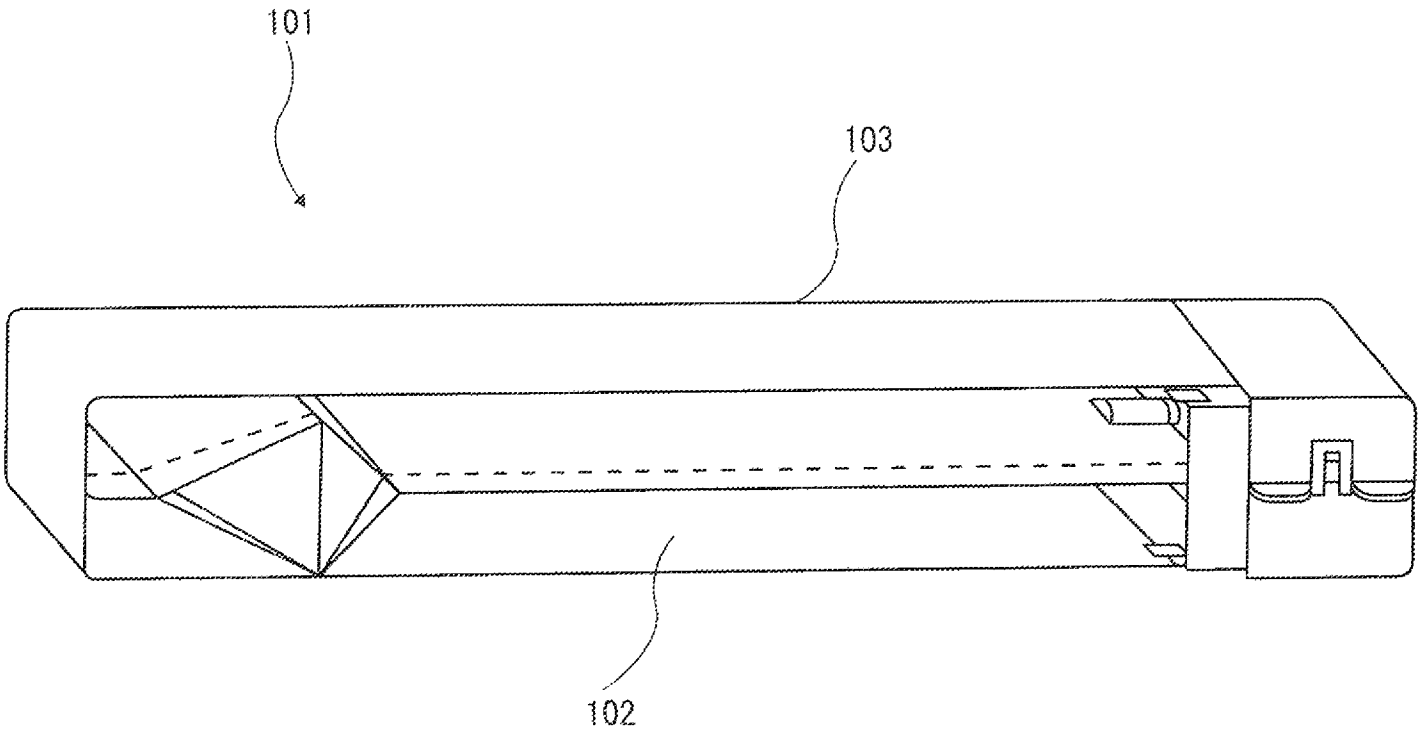
FIG. 17 is a partially cutaway perspective view showing an ink container, which has a used pouch pack, in one example of an ink container applied to a printer.

The present embodiment is described as a configuration of providing the upper face guiding part 41 and the lower face guiding part 42 of the second housing part 44 by the back faces of the rear walls of the upper recess 35 and the lower recess 36 provided in the front part of the ink container 26. However, the upper face guiding part 41 and the lower face guiding part 42 guiding the contraction of the pouch pack 31 in the upward and downward directions are not restricted to this configuration. For example, as shown in FIG. 15, an ink container 60 in another embodiment includes a square cylindrical case main body 61 having an opened front end, and a case lid 62 attachably/detachably connected to the front end of the case main body 61. The case main body 61 is configured to have an opened rear end similarly to the case main body 34 in the above-mentioned embodiment so that a spout cover 33 (see FIGS. 5, 6, and 9 to 11) is connected to the rear end.

The case lid 62 may have a pair of upper support plate 63 and lower support plate 64 at the both sides in the left and right directions and the center, respectively. The upper support plate 63 and the lower support plate 64 may be formed in a plate shape parallel with the side face of the ink container 26. In a lower edge of the upper support plate 63, an upper face guiding part 65 inclined forward and downward is formed, and in an upper edge of the lower support plate 64, a lower face guiding part 66 inclined forward and upward is formed. The upper support plate 63 and the lower support plate 64 are provided to separate from each other and can house the base end 37 of the pouch pack 31. A gap caused by the separation extends forward and is configured to house an lengthened amount of the pouch pack 31.

The case lid 62 includes a upper insertion plate 67 and a lower insertion plate 68 formed in plate shapes parallel with an upper face and a lower face of the case main body 61. The upper insertion plate 67 and the lower insertion plate 68 together with the upper support plate 63 and the lower support plate 64 are fitted inside the front end of the case main body 61. In the upper insertion plate 67 and the lower insertion plate 68, and the upper support plates 63 at the both sides, engaging crawls 69 projecting outward are formed. The respective engaging crawls 69 engage with engaging grooves (not shown) formed in an inner peripheral surface at the front end of the case main body 61 when the case lid 62 is inserted into the case main body 61.

Further, at the front end of the case lid 62, a grasping part 70 is provided. The grasping part 70 has recesses formed not only in the upper surface and the lower surface but also in the both sides. A user can easily grasp the grasping part 70 not only from the upward and downward directions but also from the left and right directions.

Although as the embodiment, configurations of the disclosure are applied to the printer 1 as the inkjet image forming apparatus, as a different embodiment, the ideas of the disclosure may be applied to a different inkjet image forming apparatus, such as a copying machine, a facsimile or a multifunction machine.

What is claimed is:

1. An ink container comprising:

a liquid storing container filled with an ink and provided with a spout discharging the ink at one end side of the ink container; and a container case containing the liquid storing container and fixing one end of the liquid storing container at the one end side, wherein the liquid storing container is configured to contract and to lengthen in forward and backward directions in accordance with reduction in the ink from a state where the ink is filled inside, and the container case includes a first housing part housing the liquid storing container in an ink filled state, and a second housing part having a height dimension smaller than a height dimension of the first housing part and housing a lengthened amount of the liquid storing container at another end side of the ink container with respect to the first housing part depending on the reduction in the ink.

2. The ink container according to claim 1, wherein one end of the second housing part of the container case at the one end side is configured so that a height dimension is reduced to taper toward the other end side and a center in upward and downward directions.

3. The ink container according to claim 1, wherein the container case has an upper recess and a lower recess formed respectively in an upper face and a lower face, and the second housing part is provided in an area sandwiched between the upper recess and the lower recess.

4. The ink container according to claim 3, wherein one end of the container case at the another end side constitutes a grasping part together with the upper recess and the lower recess.

5. The ink container according to claim 3, wherein the upper recess and the lower recess are provided with the both side walls.

6. The ink container according to claim 1 further comprising:

a pair of upper support plate and lower support plate formed in plate shapes parallel with the side face at the another end side with respect to the first housing part, wherein the upper support plate and the lower support plate are provided to separate from each other, in a lower edge part of the upper support plate, an upper face guiding part inclined forward and downward is provided, and in an upper edge part of the lower support plate, a lower face guiding part inclined forward and upward is provided.

7. An ink jet image forming apparatus comprising:

an ink container, wherein the ink container includes:

a liquid storing container filled with an ink and provided with a spout discharging the ink at one end side of the ink container; and a container case containing the liquid storing container and fixing one end of the liquid storing container at the one end side, wherein the liquid storing container is configured to contract and to lengthen in forward and backward directions in accordance with reduction in the ink from a state where the ink is filled inside, and the container case includes a first housing part housing the liquid storing container in an ink filled state, and a second housing part having a height dimension smaller than a height dimension of the first housing part and housing a lengthened amount of the liquid storing container at another end side of the ink container with respect to the first housing part depending on the reduction in the ink.

8. The ink jet image forming apparatus according to claim 7, wherein one end of the second housing part of the container case at the one end side is configured so that a height dimension is reduced to taper toward the other end side and a center in upward and downward directions.

9. The ink jet image forming apparatus according to claim 7, wherein the container case has an upper recess and a lower recess formed respectively in an upper face and a lower face, and the second housing part is provided in an area sandwiched between the upper recess and the lower recess.

10. The ink jet image forming apparatus according to claim 9, wherein one end of the container case at the another end side constitutes a grasping part together with the upper recess and the lower recess.

11. The ink jet image forming apparatus according to claim 9, wherein the upper recess and the lower recess are provided with the both side walls.

12. The ink jet image forming apparatus according to claim 7, wherein the ink container further includes a pair of upper support plate and lower support plate formed in plate shapes parallel with the side face at the another end side with respect to the first housing part, the upper support plate and the lower support plate are provided to separate from each other, in a lower edge part of the upper support plate, an upper face guiding part inclined forward and downward is provided, and in an upper edge part of the lower support plate, a lower face guiding part inclined forward and upward is provided.

* * * * *